US005243567A

United States Patent [19]

Gingerich

[11] Patent Number: 5,243,567

[45] Date of Patent: Sep. 7, 1993

[54] SONAR BEAM SHAPING WITH AN ACOUSTIC BAFFLE

[75] Inventor: Larry T. Gingerich, Annapolis, Md.

[73] Assignee: Westinghouse Electric Corp., Pittsburgh, Pa.

[21] Appl. No.: 777,865

[22] Filed: Mar. 15, 1977

[51] Int. Cl.[5] ..... H04R 23/00

[52] U.S. Cl. ..... 367/176; 181/293; 310/326; 367/153; 367/162; 367/905

[58] Field of Search ..... 181/284, 293; 340/8, 340/9, 10; 310/326, 337; 367/153, 155, 156, 157, 162, 176, 905

[56] References Cited

U.S. PATENT DOCUMENTS 2,984,313 5/1961 Gambill ..... 181/293
2,994,400 8/1961 Heller ..... 181/293
3,103,255 9/1963 Boschi et al. ..... 181/293
3,359,537 12/1967 Geil et al. ..... 340/9 X
3,718,898 2/1973 Cook et al. ..... 340/10
3,949,348 4/1976 Dorr ..... 340/8 R

FOREIGN PATENT DOCUMENTS 328974 4/1958 Switzerland ..... 181/293

*Primary Examiner*—Harold J. Tudor
*Attorney, Agent, or Firm*—D. Schron

[57] ABSTRACT

A side-looking sonar transducer which has sound absorbing material extending forwardly of the active surface of the transducer elements to diminish the acoustic response over a predetermined zone for reducing the effect of erroneous reflection signals. The surface of the sound absorbing material has a series of sharp peaks and valleys.

7 Claims, 4 Drawing Sheets

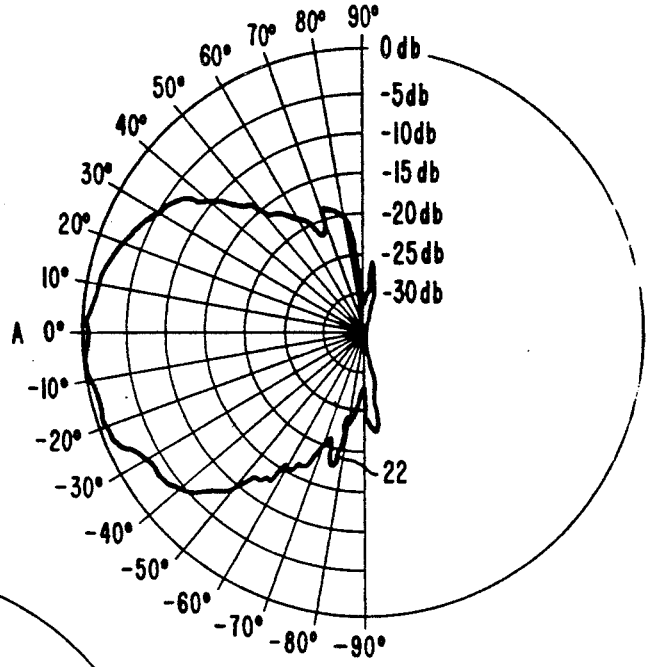
FIG.3
PRIOR ART
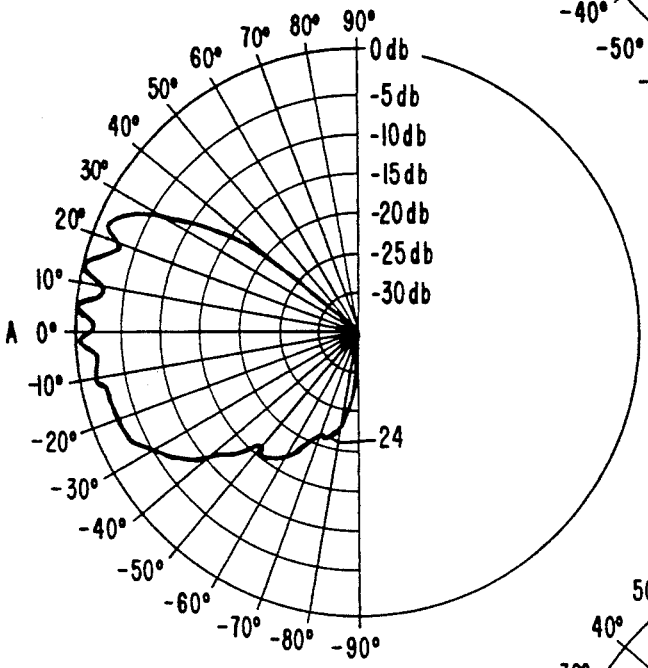
FIG.4
PRIOR ART
FIG.5
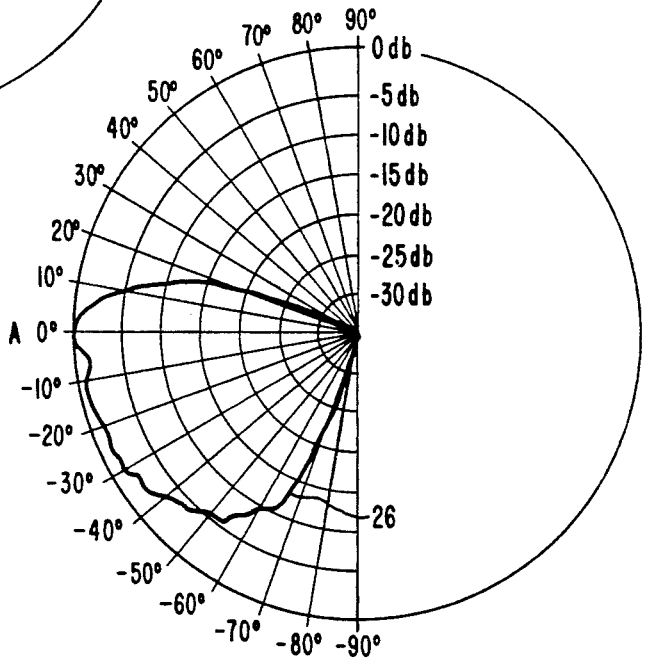

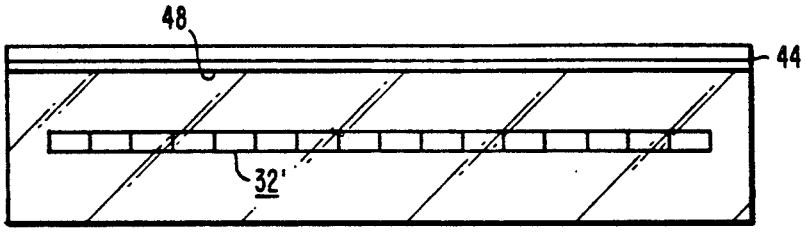
FIG.8
FIG.10
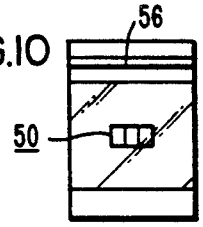
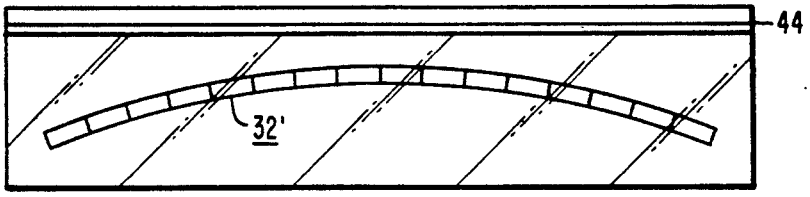
FIG.9
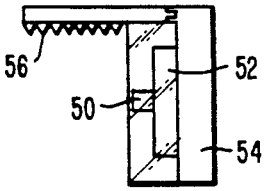
FIG.10A
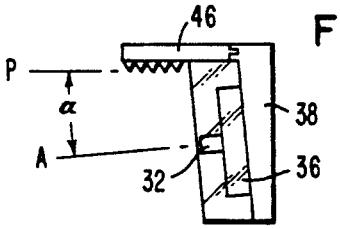
FIG.11
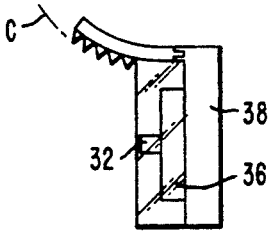
FIG.12
FIG.13
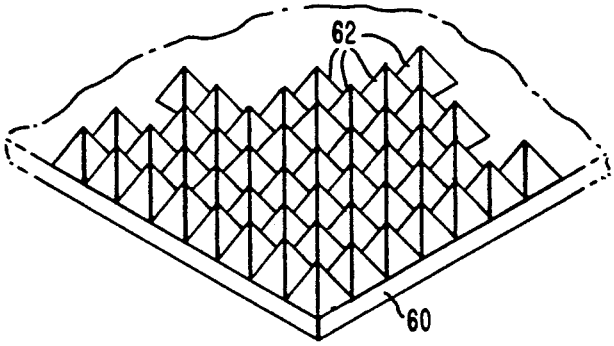

SONAR BEAM SHAPING WITH AN ACOUSTIC BAFFLE

BACKGROUND OF THE INVENTION

1. Field of the Invention

The invention in general relates to transducers, and more particularly, a beam shaping technique using an acoustic baffle.

2. Description of the Prior Art

Sonar beam patterns are determined by the shape of the active face of the active transducer elements used to project or receive the acoustic energy. Obtaining a specific beam pattern from a standard shape element requires a design of complex arrays, use of amplitude and/or phase shading, or use of reflectors or baffles.

U.S. Pat. No. 3,949,348 assigned to the same assignee as the present invention and herein incorporated by reference, describes sonar apparatus wherein the sonar beam is modified from its normal shape by the use of an acoustic absorbing material having an acoustic impedance substantially equal to that of the surrounding water medium. It has been found that such apparatus, described in the patent, under certain operating circumstances, did not provide enough of a beam pattern modification and additionally, undesirable pattern ripples showed up.

The present invention describes apparatus similar to that described in the patent; however, the objectionable features that occurred for the particular operation involved, have been eliminated.

SUMMARY OF THE INVENTION

The transducer apparatus of the present invention includes transducing means having an active surface for transmitting and/or receiving acoustic energy along an acoustic axis. The transducing means has a certain beam pattern and the acoustic response diminishes relative to the acoustic axis in accordance with the beam pattern. An acoustic absorbing material having an acoustic impedance substantially equal to the acoustic impedance of the medium in which the transducer apparatus is operating is positioned relative to the transducing means to absorb a portion of the acoustic energy projected or received.

The acoustic absorbing material has a surface which includes a plurality of peaks and valleys. In one embodiment the transducer means is an elongated side-looking sonar transducer and the peaks and valleys of the acoustic absorbing material are also elongated and parallel to one another. Another embodiment includes a plurality of peaks and valleys in the form of a plurality of individual pyramidal shaped areas.

BRIEF DESCRIPTION OF THE DRAWINGS

FIG. 3 is a polar plot of the beam pattern illustrated in conjunction with the transducer of FIG. 2;

FIG. 4 illustrates the beam pattern obtained with the apparatus described in U.S. Pat. No. 3,949,348 under certain operating conditions;

FIG. 5 is a beam pattern obtained with the present invention;

FIG. 8 is an elevational view of the apparatus with a straight line array side-looking sonar transducer;

FIG. 9 is an elevational view of the apparatus with a curved line array side-looking sonar transducer;

FIG. 10 is an elevational view and FIG. 10A is an end view of a projector transducer for the system illustrated in FIG. 1, and utilizing the present invention;

FIG. 11 is an end view of the apparatus illustrating a different angular relationship than that described in FIG. 6;

FIG. 12 is an end view of the transducer apparatus illustrating a curved baffle arrangement; and FIG. 13 illustrates another embodiment of the baffle surface.

DESCRIPTION OF THE PREFERRED EMBODIMENTS

Although the present invention may be utilized in a variety of embodiments, the apparatus will be described with respect to sonar uses, and particularly to a side-looking sonar device.

In side-looking sonar systems, acoustic energy is projected toward the sea bottom to insonify it and an elongated receiving transducer, in conjunction with signal processing means, receives information from an extremely narrow elongated insonified area on the bottom and perpendicular to the direction of travel. In order to increase the coverage rate, some side-looking sonar systems are multibeam systems wherein a plurality of adjacent beams, for examining a plurality of adjacent elongated areas, are formed for each transmission of a series of repetitive transmissions. The resulting returns are then displayed, either in real time, or are recorded for subsequent display.

Figure 1:
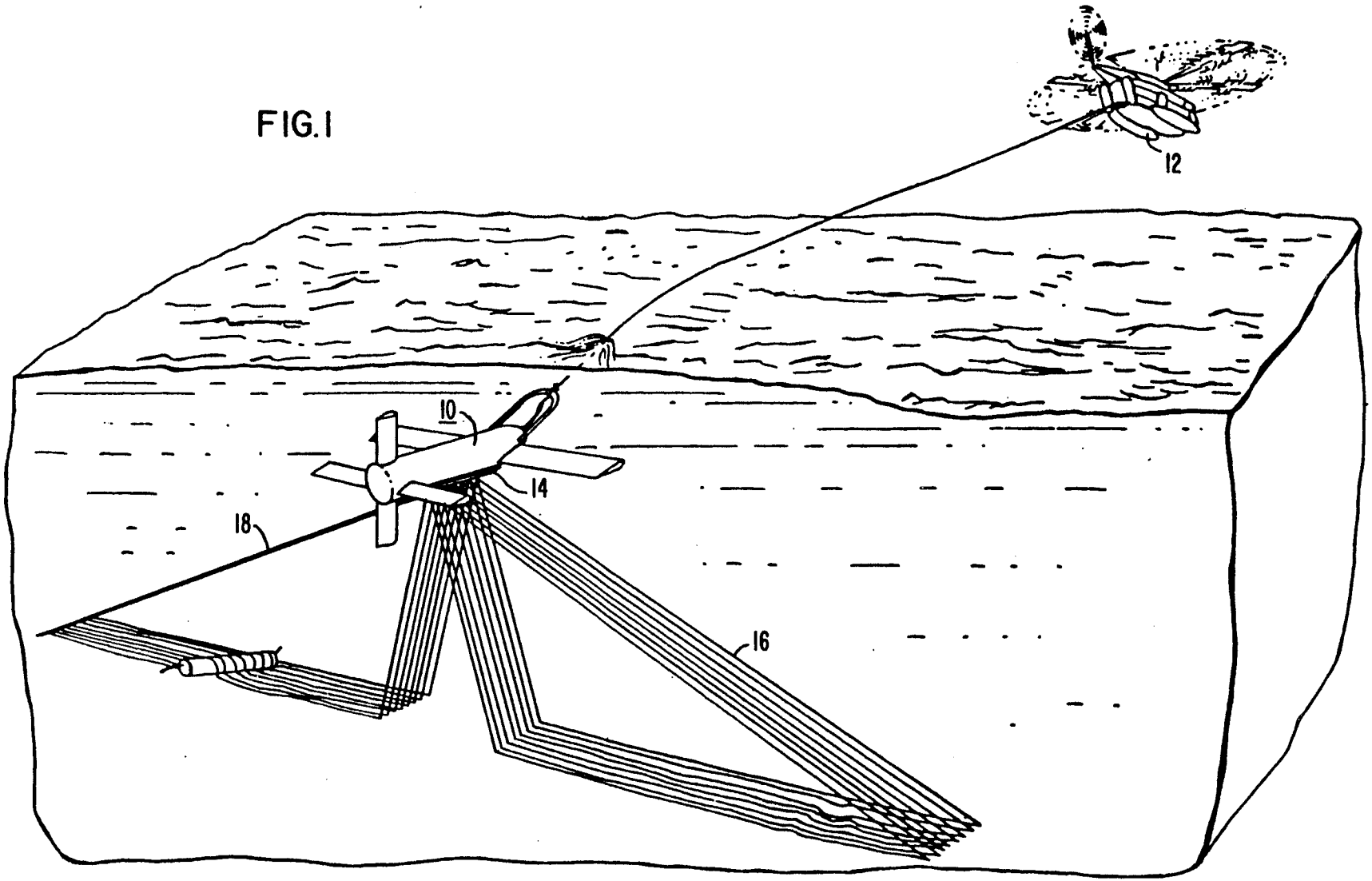
FIG. 1 illustrates the transducer apparatus in a typical undersea environment.

FIG. 1 illustrates one type of multibeam system wherein a carrier 10 is towed by means of a helicopter 12 by way of example. Mounted on the carrier is a side-looking sonar system including a starboard side-looking sonar transducer 14 for forming multiple beams 16, and for even greater coverage a port side-looking sonar transducer would be utilized for forming beams 18.

For some side-looking sonar transducers utilizing a single beam the target area may be insonified by the same transducer as is used for receiving acoustic returns from the target area. In multibeam systems, however, a separate transducer may be utilized for flooding the sea bottom with acoustic energy over an area at least equal to the area examined by the plurality of adjacent beams.

Figure 2:
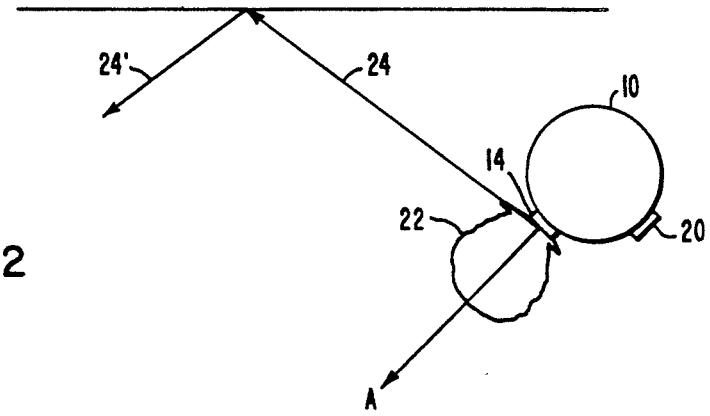
FIG. 2 is a front view of the underwater apparatus of FIG. 1 and illustrating a typical problem encountered.

In FIG. 2 there is illustrated a head-on view of the underwater carrier 10. For clarity, the vertical and horizontal fins and wings have been omitted from the drawing. Acoustic energy is transmitted in the direction of the acoustic axis A and the beam pattern 22 associated with the transducer 14 has been superimposed on the drawing. Beam pattern 22 may be representative of either the transmitted beam or one of the receiver beams.

Maximum acoustic energy is propagated or received along the acoustic axis and the acoustic response of the transducer diminishes relative to the axis in accordance with beam pattern 22. Acoustic energy, however, may also be propagated toward the sea surface, as indicated by acoustic ray 24 which is reflected from the sea-air interface such that reflected acoustic ray 24' will impinge upon the target area and which represents a potential source of error in the final display.

In the receive mode of operation, acoustic ray 24' would represent not only energy reflected directly back as a result of a transmission but reflected energy from the target area which will be received at transducer 14 after reflection from the sea-air interface; and if the signal level is high enough, degradation of the display will take place. The problems associated with the starboard transducer 14 are also applicable with respect to the port transducer arrangement 20.

Typical beam pattern 22 is reproduced in FIG. 3 which is a polar plot wherein the concentric circles about the origin represent relative pressure and the radii represent angular orientation. The outermost circle represents normalized acoustic sound pressure and this maximum response is designated 0 db. (decibels). The next circle represents a magnitude of lesser sound pressure and is −5 db. or 5 db. down. Subsequent concentric circles of diminishing radius represent proportionally lesser sound intensities. The apparatus of U.S. Pat. No. 3,949,348 has been utilized to modify the beam pattern of FIG. 3 to reduce its off-axis response and to reduce the effects of reflection. For one particular embodiment, however, and for operation at a particular frequency it was found that the resulting beam pattern was like beam pattern 24 of FIG. 4. The response, for example, at +20°, 2 db. down, was deemed to be not down enough, as was the response at +30°, 8 db. down. In addition, the beam pattern exhibited an objectionable scalloped effect between −10° and +25°. It is believed that the effect might have been due to reflections from the smooth surface of the absorber at the particular frequency utilized.

FIG. 5 illustrates the resulting beam pattern of the present invention and it is seen that the response at, for example, 30° is completely eliminated and the response at 20° has been reduced to 19 db. down. In addition, the objectionable scalloping effect is no longer present. The beam patterns illustrated in FIGS. 3, 4 and 5 are actual beam patterns of the projector portion of the apparatus; however, the receiver portion would form similar beams.

Figure 6:
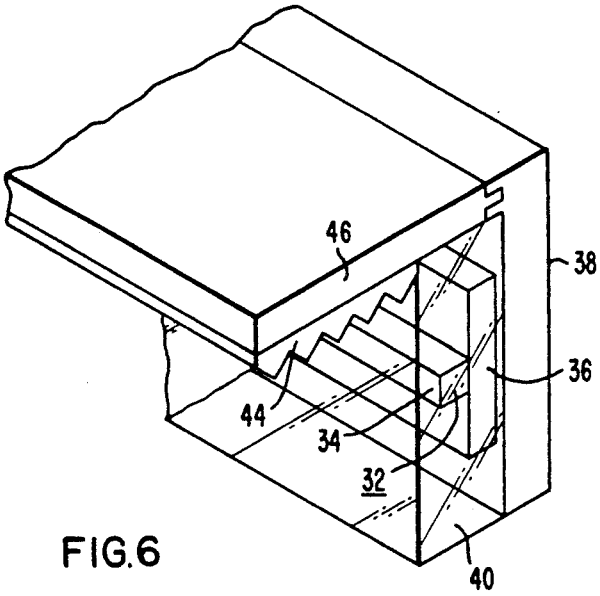
FIG. 6 illustrates one embodiment of the present invention.

FIG. 6 illustrates an embodiment of the present invention with respect to an elongated side-looking sonar receiver transducer. The transducer includes transducing means 32 having an active surface 34 for transmitting and/or receiving acoustic energy. One example of a transducing means which may be utilized is barium titanate and in the construction of such transducers the barium titanate is formed in a plurality of short segments arranged end-to-end along a line.

Figure 7:
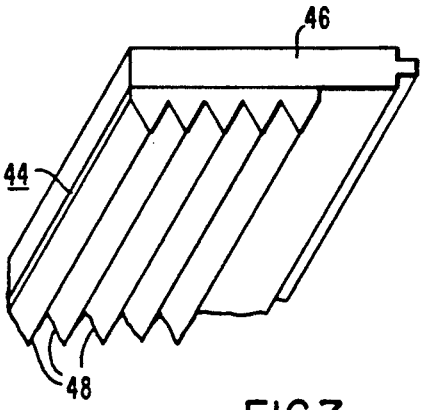
FIG. 7 is an underside view of the baffle illustrated in FIG. 6.

Positioned behind the transducing means 32 is a backing means 36 such as Corprene or Ecco-Foam for providing an acoustic mismatch for acoustic energy propagated from the rear surface of the barium titanate elements. The backing means is carried by a mounting means 38 which is connected to the carrier 10 of FIG. 1. In order to protect the elements from the surrounding water medium, a potting compound 40 is utilized and has a similar acoustic impedance as that of the sea water, one example being polyurethane. In order to modify the top portion of the beam pattern an acoustic baffle 44 is positioned forwardly of the transducing means and is made out of an acoustic absorbing material having an acoustic impedance substantially equal to that of the surrounding medium, sulfur free butyl rubber being one example. The surface of the baffle 44 is characterized in having a plurality of peaks and valleys exposed to the acoustic energy received by the transducer, or in the case of a transmitter, transmitted by the transducer. The acoustic baffle 44 is mounted on a support 46 which may be connected to or be formed as a part of the mounting means 38. An underside view of just the acoustic baffle 44 is illustrated in FIG. 7 and it is seen to include a plurality of peak lines 48 which are parallel to one another, as would be the valley lines. It is believed that the sharp edges of the wedge-shaped peaks cause acoustic diffraction around the peak edges so that the acoustic energy is directed into the bottom of the grooves where it is absorbed.

FIG. 8 illustrates a side or elevational view of the apparatus of FIG. 6 and shows the relationship between the elongated transducing means 32 and acoustic baffle 44. That is, in the embodiment illustrated the active elements are arranged end-to-end along a straight line which is parallel to the peak lines 48 of acoustic baffle 44. For high resolution work at a predetermined altitude over the target area, use is made of curved transducer 32', such as illustrated in FIG. 9 wherein the active elements are arranged along a curved line having a radius of curvature equal to the design altitude.

FIG. 10 illustrates a side view and FIG. 10A illustrates an end view of a projector transducer arrangement utilizing the present invention. The transducing means 50 for the projector is generally made up of a plurality of active elements; however, the length of the transducing means is much less than that of the receiver transducing means. Backing and mounting means 52 and 54 are provided as was the receiver case and an acoustic baffle 56 similar to that of FIG. 6 is provided; however, with the case of the transmitter, the acoustic baffle extends a greater distance from the transducing means than that illustrated in FIG. 6.

In the embodiment of FIG. 6 the acoustic axis of the transducer is generally parallel to the baffle support 46 or, in other words, parallel to the plane of the peaks of the baffle. In FIG. 11 there is shown an alternate arrangement wherein the acoustic axis A is at a predetermined angle $\alpha$ with respect to the plane P of the baffle peaks. This angle $\alpha$ may be varied according to design parameters to optimize beam pattern smoothness. Although the depression angle $\alpha$ in FIG. 11 is obtained by having the backing means 36 attached to a wedge-shaped mounting means 38, the angle could be achieved just as well with an inserted wedge or a wedge-shaped backing means.

FIG. 12 illustrates an alternate embodiment wherein the acoustic baffle is generally of a curved configuration, more particularly, the peak lines of the acoustic baffle, although parallel to one another, would additionally lie in a curved plane C (the edge of which is illustrated in FIG. 12).

Since the theory of operation is based upon the diffraction of acoustic energy around tips of edges so as to direct the energy to the bottom of grooves where it is absorbed, other surface arrangements may additionally be utilized. One such other surface is depicted in FIG. 13, which illustrates an acoustic baffle 60 of an acoustic absorbing material having the same acoustic impedance as that of the surrounding medium and which includes a surface having a plurality of peaks and valleys. In the embodiment of FIG. 13, however, there are no peak lines. The peaks and valleys are formed by adjacent pyramid-shaped areas 62 to perform the diffraction and absorbing function. Other arrangements are possible, including a combination of elongated grooves as in FIG. 6 with pyramidal areas as in FIG. 13.

I claim:

1. Transducer apparatus comprising:

a. elongated transducing means having an active surface for transmitting and/or receiving acoustic energy;

b. said transducing means having associated therewith a certain beam pattern having a direction of maximum acoustic response and wherein acoustic response diminishes relative to said maximum as the angular displacement from said maximum is increased positively or negatively, and in accordance with said beam pattern;

c. acoustic absorbing material having an acoustic impedance substantially equal to that of the medium in which said apparatus operates and positioned relative to said active surface to absorb a portion of forwardly projected and/or received acoustic energy to modify said beam pattern to reduce the response over a predetermined zone forward of said active surface and angularly displaced from said direction of maximum response;

d. said acoustic absorbing material having a surface defined by a plurality of "V"-shaped peaks and valleys exposed to said acoustic energy, with said valleys being elongated grooves, and each said peak defining an elongated line;

e. both said elongated grooves and elongated lines extending in the same general direction as said elongated transducing means.

2. Apparatus according to claim 1 wherein:

a. said peak lines are parallel to one another.

3. Apparatus according to claim 1 wherein:

a. said lines lie in a common plane.

4. Apparatus according to claim 1 wherein:

a. said lines lie in a curved surface.

5. Apparatus according to claim 3 wherein:

a. said plane is parallel to said direction of maximum acoustic response.

6. Apparatus according to claim 3 wherein:

a. said plane is at an angle ($\alpha$) with respect to said direction of maximum acoustic response.

7. Apparatus according to claim 1 wherein:

a. said grooves are "V"-shaped.

* * * * *